US005811725A

United States Patent [19]

Klager

[11] Patent Number: 5,811,725

[45] Date of Patent: Sep. 22, 1998

[54] HYBRID ROCKET PROPELLANTS CONTAINING AZO COMPOUNDS

[75] Inventor: Karl Klager, Sacramento, Calif.

[73] Assignee: Aerojet-General Corporation, Rancho Cordova, Calif.

[21] Appl. No.: 748,738

[22] Filed: Nov. 18, 1996

[51] Int. Cl.[6] ..... C06B 45/10

[52] U.S. Cl. ..... 149/19.4; 149/19.1; 149/19.5; 149/36; 149/109.4; 60/219

[58] Field of Search ..... 60/219; 149/19.1, 149/19.4, 36, 19.5, 109.4

[56] References Cited

U.S. PATENT DOCUMENTS

| | | | |
|---|---|---|---|
| 2,728,760 | 12/1955 | Kenney . | |
| 3,096,312 | 7/1963 | Henry . | |
| 3,140,582 | 7/1964 | Tyson, Jr. . | |
| 3,171,249 | 3/1965 | Bell . | |
| 3,219,499 | 11/1965 | Graham . | |
| 3,244,702 | 4/1966 | Marcus | 149/19.1 |
| 3,336,837 | 8/1967 | Anger . | |
| 3,350,374 | 10/1967 | Fetscher et al. . | |
| 3,640,070 | 2/1972 | Kaufman et al. | 60/219 |
| 3,697,339 | 10/1972 | Satten et al. | 149/19.1 |
| 3,727,407 | 4/1973 | Rains et al. | 149/36 |
| 3,734,789 | 5/1973 | Moy et al. . | |
| 3,940,298 | 2/1976 | Beckert et al. . | |
| 3,967,989 | 7/1976 | Hawthorne . | |
| 4,013,596 | 3/1977 | Ernberg | 149/19.1 |
| 4,023,352 | 5/1977 | Sayles | 149/36 |
| 4,065,332 | 12/1977 | Lorson et al. | 149/19.9 |
| 4,206,006 | 6/1980 | Ratz | 149/19.9 |
| 4,288,262 | 9/1981 | Flanagan et al. . | |
| 4,432,817 | 2/1984 | Frankel et al. . | |
| 4,482,404 | 11/1984 | Witucki et al. . | |
| 4,581,082 | 4/1986 | Hagel et al. . | |
| 4,925,909 | 5/1990 | Kubota et al. | 149/19.4 |
| 4,938,814 | 7/1990 | Schoyer et al. . | |
| 4,950,341 | 8/1990 | Schoyer et al. . | |
| 5,188,682 | 2/1993 | Lochner et al. | 149/1 |
| 5,198,046 | 3/1993 | Bucerius et al. . | |
| 5,339,624 | 8/1994 | Calsson et al. | 60/219 |
| 5,388,519 | 2/1995 | Guindon et al. . | |
| 5,466,315 | 11/1995 | Erickson et al. . | |
| 5,509,981 | 4/1996 | Dean | 149/19.4 |

FOREIGN PATENT DOCUMENTS

| | | |
|---|---|---|
| 55-136195 | 4/1979 | Japan . |
| 57-117307 | 1/1981 | Japan . |
| 578081 | 3/1943 | United Kingdom . |

OTHER PUBLICATIONS

VASO Product Literature, DuPont Company (E–93156) 10 pages.

D. Altman, "Hybrid Rocket Development History," AIAA 91–2515, AIAA/SAE/ASME/ASEE 27th Joint Propulsion Conference (Jun. 24–26, 1991).

C.B. Luchini, et al., "Investigation of GAT as a High Regression Rate Hybrid Rocket Fuel," AIAA 96–2592, AIAA/ASME/SAE/ASEE 32nd Joint Propulsion Conference (Jul. 1–3, 1996).

*Primary Examiner*—Edward A. Miller

*Attorney, Agent, or Firm*—Townsend and Townsend and Crew LLP

[57] ABSTRACT

Hybrid rocket propellants are disclosed that contain azo compounds, i.e., compounds containing the group R—N═N—R' as part of their structure, where R and R' represent a variety of groups including aliphatic, alicyclic and heterocyclic groups. The azo compounds are mixed with the other solid components of the propellant grain and serve either as plasticizers, binders, fuels, or fillers. The effect of including the azo compounds is an increase in the regression rate of the grain as the propellant burns.

26 Claims, 2 Drawing Sheets

*Fig. 1 - PRIOR ART*

HYBRID ROCKET PROPELLANTS CONTAINING AZO COMPOUNDS

BACKGROUND OF THE INVENTION

1. Field of the Invention

This invention lies in the field of rocket propellants, and particularly hybrid propellants.

2. Description of the Prior Art

Rocket propellants originated in the 1200's, when rockets with solid propellant materials were invented in China. Rockets with liquid propellants appeared much later, with the first tests being performed in the 1800's. Liquid propellants reached an advanced stage after World War I, when they were used in rockets traveling long distances and subsequently for launching vehicles into space. While liquid propellants could be stopped and restarted an unlimited number of times, however, solid propellants still offered the advantage of simplicity and readiness of use.

For military purposes, the rockets initially used were small solid rockets with black powder propellants. When the black powder was replaced with composite propellants, which consist of an energetic polymeric binder, a plasticizer, a curing agent, and an oxidizer, the performance was improved by a factor of 2. Still further improvement was achieved by the inclusion of metal powder in the propellant mixture, raising the performance of solid propelled rockets to a level competitive with liquid propelled rockets. This, combined with the other advantages such as instant readiness, low cost and ease of storage have made solid propellants the propellants of choice. Currently, intercontinental ballistic missiles are manufactured almost entirely with solid propellants.

Considerations of safe handling and concern for the environment have led to experiments with hybrid propellants, in which all components are solid except for the oxidizer which is fluid. Hybrid propellants offer cost advantages, high theoretical performance, stop-start capability, and the highest safety of all types of propellants. Hybrid propellants have not progressed to widespread use, however. The primary difficulty is that hybrid propellants suffer a low regression rate, i.e., the rate at which the combustion front penetrates the solid grain and travels in the direction perpendicular to the grain surface.

The sole source of gas generation in a hybrid propellant is the polymeric hydrocarbon binder. The first conversion undergone by the binder in the operation of the rocket is endothermic pyrolysis in which the polymer is converted to a gaseous fuel. Thus, the regression of the propellant grain is the result of pyrolysis rather than burning, and is therefore considerably slower than that of a burning propellant. Furthermore, as vaporized oxidizer contacts the gaseous fuel above the surface of the propellant grain, the gaseous fuel burns, but this occurs while the gases proceed through a succession of flow regimes in the direction of flow. The first regime is laminar flow where the fuel and oxidizer are predominantly separated; this is followed by a transient region and finally a turbulent region in which the combustion proceeds to completion. The presence of all three regimes limits the burning rate and efficiency of the propellant.

Higher regression rates have been achieved with the development of fuels such as poly(azidomethylethylene oxide) (GAP) and 3,3-bis-(azidomethyl)oxetane (BAMO), but the greatest contribution of these fuels has been an improvement in mechanical properties. The incorporation of additives and fillers has led to further improvements in the mechanical properties, but new problems arose such as combustion instability. In any event, the low regression rate continues to be a problem.

SUMMARY OF THE INVENTION

It has now been discovered that the regression rate of a hybrid propellant can be increased by the inclusion of one or more azo compounds in the solid portion of the propellant composition, the azo compound being one that decomposes upon heating to nitrogen gas and free radicals. The nitrogen gas transports the liberated free radicals into the oxidizer stream, creating or increasing the turbulence in the flowing stream and thereby increasing the burning rate, while the decomposition erodes the propellant mass and increases the regression rate. The two effects in combination cause a faster development of pressure and heat which provide the rocket with a greater thrust.

The azo compounds are those that contain the group R—N═N—R' in their structure, where R and R' are variable groups that can range widely in structure and atomic content. The R—N═N—R' group may constitute the entire structure of the compound, or only a part in which it is attached to other groups that may also contain the azo (—N═N—) group. The compound can be polymeric (linear or crosslinked) or non-polymeric, and may substitute for any of the various solid components constituting the propellant grain by incorporating into its structure functional groups that are characteristic of these components. The compound may thus be a plasticizer, a binder, or a fuel. Alternatively, the compound can simply be an additive with little or no function other than to generate the nitrogen and free radicals.

Details of these and other features of the invention will be apparent from the description that follows.

DETAILED DESCRIPTION OF THE INVENTION AND PREFERRED EMBODIMENTS

Figure 1:
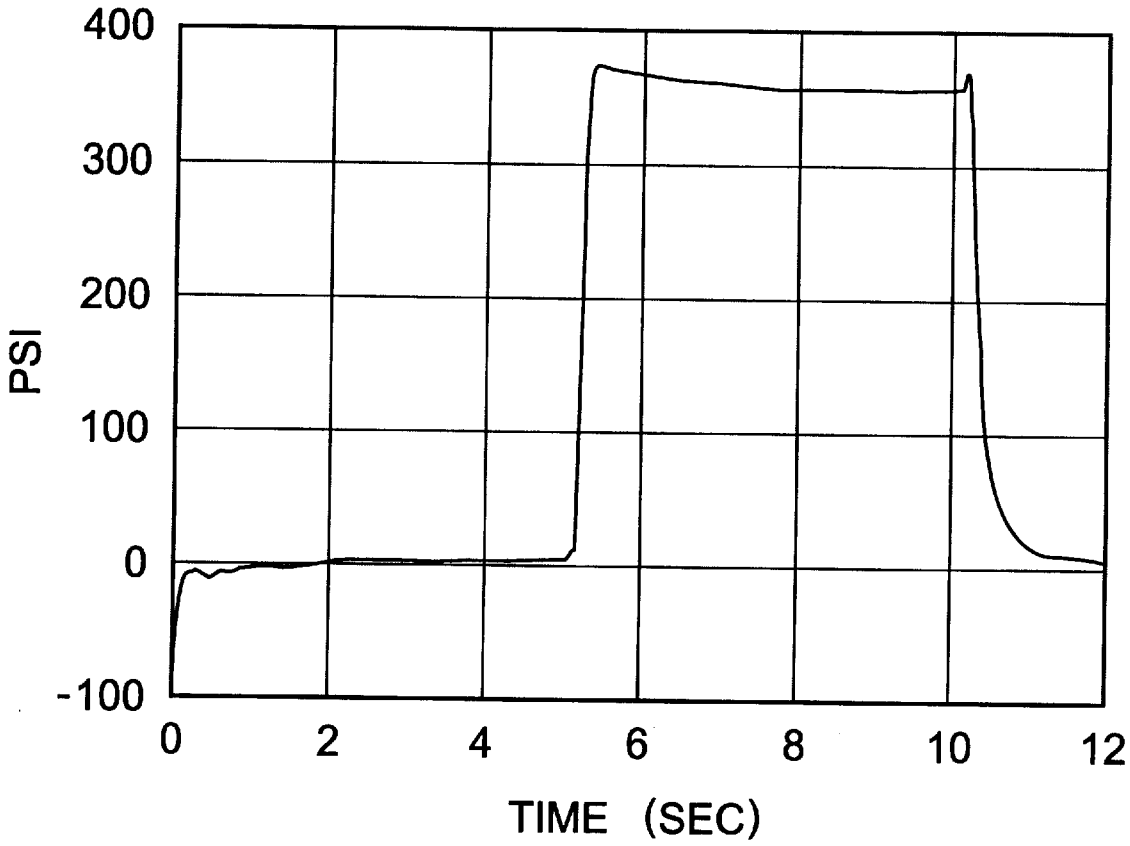
FIG. 1 is a plot of a firing run of a hybrid propellant grain formulation of the prior art.

The critical features of the azo compound are that it remain stable at ambient temperature and decompose upon heating to liberate nitrogen gas and free radicals that will create a high surface area in the propellant grain and thereby promote the combustion of the remaining components of the propellant. Preferred decomposition temperatures are those that are 110° C. or higher. Compounds that decompose or melt at lower temperatures can also be used, however, particularly if they are compatible with the binder to form a plasticized mass. In further preferred embodiments of the invention, the compound has additional qualities and characteristics rendering its performance even more favorable.

Included among these preferred embodiments are compounds that have a positive heat of formation. A further preference is compounds in which at least one, and possibly both, of the groups R and R' contain a nonaromatic carbon at the site of attachment to the N═N. It is still further preferred that at least one, and possibly both, of the groups R and R' lack aromatic structures entirely.

Within these preferences, the structures of R and R' can vary widely. In certain preferred embodiments, for example, either R or R' or both are either aliphatic, alicyclic or heterocyclic radicals, optionally substituted with any of a variety of substituents. The term "aliphatic" is used herein to denote an organic radical with either a straight-chain or branched-chain arrangement of the constituent carbon atoms. Aliphatic radicals include paraffin (alkyl) radicals, olefinic radicals (such as alkenyls and alkadienyls), and acetylenic (alkynyl) radicals. The term "alicyclic" is used herein to denote an organic radical characterized by arrangment of the carbon atoms in a closed ring structure that is not an aromatic structure, i.e., the ring structure does not contain phenyl groups. Alicyclic structures include cycloparaffins, cycloolefins, and cycloacetylenes. Specific examples of particular interest are the cyclopropyl, cyclopentyl and cyclohexyl groups. The term "heterocyclic" is used herein to denote a closed-ring structure, usually of five or six members, in which one or more of the atoms in the ring is an element other than carbon, for example, sulfur, nitrogen, oxygen, or two or more of these in the same ring. Examples are pyridinyl, pyrimidinyl, pyrrolyl, pyrazolyl, furyl, triazolyl, tetrazolyl, triazinyl, tetrazinyl, thiophenyl, and purinyl.

When R, R' or both are substituted aliphatic, alicyclic or heterocyclic, single or multiple substituents may be present, and if multiple, the substituents may be the same or different. The substituents themselves can vary widely. Some examples are —CN, —OH, —OR", —COOH, —COOR", —CO—$NH_2$, and —CO—NHR", in which R" is either lower alkyl or hydroxy-substituted lower alkyl. Preferred lower alkyl groups are $C_1$–$C_3$ alkyl.

One preferred structure of the azo compound is defined by Formula I:

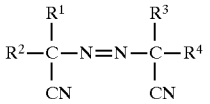

(I)

In this formula, the symbols $R^1$, $R^2$, $R^3$, and $R^4$ represent radicals that are either the same or different, and each is one of the following: H, $C_1$–$C_8$ alkyl, $C_1$–$C_8$ alkyl substituted with $C_1$–$C_3$ alkoxy or —COOH, and $C_2$–$C_8$ alkyl interrupted by either —O— or —O—. Alternatively, $R^1$ and $R^2$ may be combined to form a $C_5$–$C_8$ alicyclic group, with $R^3$ and $R^4$ as defined above; or $R^1$ and $R^2$ may be combined to form a first $C_5$–$C_8$ alicyclic group, while $R^3$ and $R^4$ are combined to form a second $C_5$–$C_8$ alicyclic group. A subgroup of interest within this preferred structure is that in which $R^1$ and $R^3$ are each methyl, and $R^2$ and $R^4$ are the same or different and are each either H, $C_1$–$C_8$ alkyl, $C_1$–$C_8$ alkyl substituted with either $C_1$–$C_3$ alkoxy or —COOH, or $C_2$–$C_8$ alkyl interrupted by either —O— or —COO—. Another subgroup of interest is that in which $R^1$ and $R^3$ are each methyl, and $R^2$ and $R^4$, which are the same or different, are each either $C_1$–$C_4$ alkyl, $C_1$–$C_4$ alkyl substituted with $C_1$–$C_3$ alkoxy or —COOH, or $C_2$–$C_4$ alkyl interrupted by —COO—. A third subgroup of interest is that in which $R^1$ and $R^2$ are combined to form one $C_5$–$C_8$ nonaromatic cyclic group, and $R^3$ and $R^4$ are combined to form a second $C_5$–$C_8$ nonaromatic cyclic group.

A second preferred structure of the azo compound is defined by Formula II:

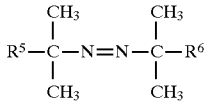

(II)

in which $R^5$ and $R^6$, which are either the same or different, are each either $C_1$–$C_8$ alkyl, $C_5$–$C_8$ cycloalkyl, —CO—O—$R^7$, —CO—$NH_2$, —CO—$NHR^7$,

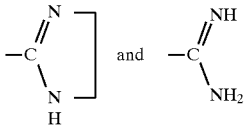

$R^7$ is defined as either $C_1$–$C_6$ alkyl or hydroxy-substituted $C_1$–$C_6$ alkyl.

The R—N=N—R' group can be symmetrical or asymmetrical, i.e., R and R' can be either the same or different. In some cases, asymmetrical compounds or groups will be more stable than symmetrical compounds or groups, and will therefore be preferred.

Specific examples of azo compounds are as follows:

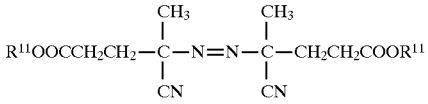

(III)

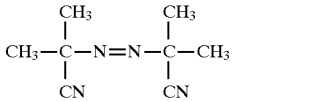

(IV)

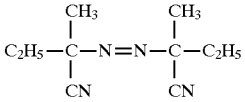

(V)

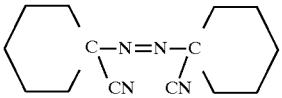

(VI)

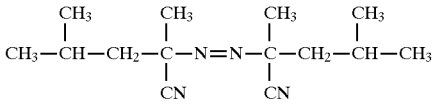

(VII)

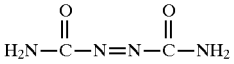

(VIII)

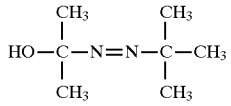

(IX)

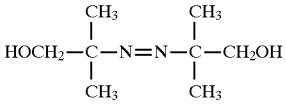

(X)

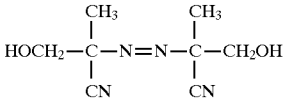

(XI)

-continued

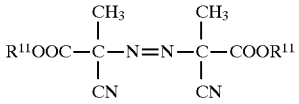
(XII)

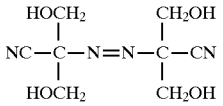
(XIII)

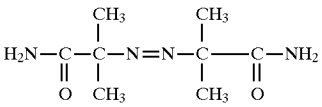
(XIV)

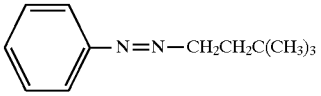
(XV)

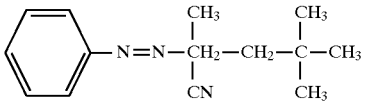
(XVI)

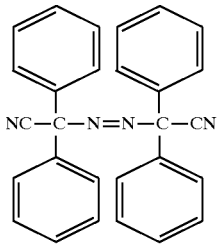
(XVII)

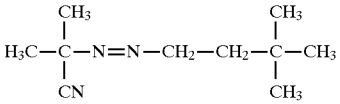
(XVIII)

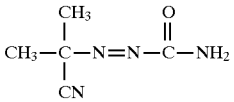
(XIX)

In the formulas where it appears, $R^{11}$ is $C_1$–$C_3$ alkyl.

All of these azo compounds are commercially available or readily prepared by conventional synthesis techniques that are either well known or would be readily apparent to those skilled in the art. Many of the compounds are known as blowing agents (porofors) for rubbers or plastics; others are known as azo polymerization or halogenation initiators. Suppliers include Wako Chemicals USA, Inc., Richmond, Va., USA (products under trade names such as V-70, V-65, V-60, V-601, V-59, V-40, V-30, VR-110, V-19, VR-160, VA-044, V-50, VA-061, V-501, VA-080, VA-082, VA-086, and VA-088), and Du Pont Company, Chemicals & Pigments Department, Wilmington, Del., USA (products identified as VAZO® Free Radical Sources).

The compound that contains the R—N═N—R' group can be any of the various solid components of the propellant. The compound can serve for example as a plasticizer, binder or fuel, and two or more such compounds can be included to serve two or more of these functions. An example of a plasticizer is the compound of Formula III above. Examples of binders are polymers such as polyurethanes, polyamides, and polyesters, formed from the compounds. The compound can thus be a diol or other polyol that can combine with an isocyanate, including diisocyanates and polyisocyanates, to form a crosslinked polyurethane. Similarly, the compound can be one that is curable with an epoxy compound to form a crosslinked polyester. The compound itself can be a prepolymer, and if so, a preferred range of molecular weight is from about 100 to about 15,000, and more preferably from about 500 to about 15,000. The azo compound can also contain any of a variety of reactive groups in its structure that add to the caloric value of the fuel. One such reactive group is the nitro ($NO_2$) group. Azo compounds that serve no additional reactive function other than the generation of nitrogen gas and free radicals can also be used; these compounds will serve as fillers in the solids mixture. As fillers, the compounds can be used to control the mechanical properties of the solids mixture, such as by increasing the hardness and hence the structural stability of the mixture through exposure to both high and low temperature prior to burning.

The amount of azo compound included in the propellant mixture can vary widely, depending on the amount of additional turbulence that the compound is intended to generate in the combustion gases. The actual amount is not critical. In most applications, however, effective results will be achieved with amounts within the range of about 5% to about 70% by weight of the solid components, preferably from about 30% to about 60% by weight. A particularly preferred formulation is one that contains about 50% by weight, as presently conceived.

The remaining components of the hybrid propellant mixture are the same as those of hybrid propellants of the prior art. These include binders (often comprised of two components), plasticizers, and fuels, although as indicated above, one or more of these can be replaced, in full or in part, with an azo compound of a structure appropriately selected from those shown and described above.

The following examples are offered for purposes of illustration, and are not intended to impose limits on the scope of the invention.

EXAMPLE 1—Prior Art

A hybrid propellant fuel in accordance with the teachings of the prior art was prepared by placing 1903.8 parts by weight of hydroxypolybutadiene R 45 AS (100 equivalents) in a mixer and mixing it under vacuum for 5 minutes at room temperature. Hexamethylene diisocyanate (96.92 parts by weight) was then added, and mixing was continued for another 5 minutes, while material adhering to the mixer wall was repeatedly scraped down into the mix. The mix was then heated to 140° F. (60° C.), and mixing was continued, still under vacuum, for an additional 5 minutes. The mix was then cast in an insulated mold and a core rod was inserted. The mold was then vibrated. Curing in the mold was completed in two weeks at 140° F. (60° C.) to a Shore A hardness of 9.

EXAMPLE 2—This Invention

A hybrid propellant incorporating an azo compound in accordance with the present invention was prepared by placing 2133.58 parts by weight of hydroxypolybutadiene R 45 AS (100 equivalents) in a mixer and mixing it without vacuum for 5 minutes at room temperature. Azodicarbonamide (400 parts by weight) was then added, and mixing was continued for another five minutes without vacuum, followed by the addition of further azodicarbonamide (350 additional parts by weight), which was added slowly at ambient temperature, followed by an additional five minutes of mixing, again without a vacuum. Materials adhering to the mixer walls were scraped into the mix. Vacuum was then gradually applied and mixing continued for ten minutes. To the mix was then added 116.42 parts by weight of hexamethylene diisocyanate, and mixing was continued under vacuum for five minutes. Material adhering to the walls was incorporated into the mix and the mix was heated to 140° F. (60° C). Mixing at this temperature was continued for fifteen minutes under vacuum. The mix was then cast into an insulated mold with a core rod as in Example 1, and cured at 140° F. (60° C.) until hard. Curing was completed in four days, and the final cured formulation had a Shore A hardness of 10.

Hazard tests were performed on the propellant with the following results:

Bureau of Mines Impact Sensitivity: greater than 100 cm/2 kg

Rotary Friction (g at 2,000 rpm): greater than 4,000

Electrostatic Sensitivity: greater than 1 joule

Differential Thermal Analysis: onset: 369° F.; exotherm 391° F.

Firing tests were performed on propellant formulations prepared as in Examples 1 and 2 using standard test procedures. The propellant formulation representing this invention had a hydroxypolybutadiene/azodicarbonamide weight ratio of 75:25. The test conditions and burning results are presented in Table I below and in FIGS. 1 and 2, respectively. The symbol $P_c$ in this table represents the chamber pressure of the rocket during firing. Regression rates are measured as the difference in diameter of the rocket bore before and after firing divided by the time during which firing occurred. The consumption rate is the difference in weight of the propellant before and after burning, again divided by the time during which firing occurred.

TABLE I

Firing Test Conditions and Results

| | Prior Art Propellant Formulation | Propellant Formulation of Invention |
|---|---|---|
| Oxygen Flow Conditions: | | |
| Set pressure, psi | 1185 | 1210 |
| Flow weight, lb/sec | 0.0335 | 0.334 |
| Fuel Weights: | | |
| Pretest weight, g | 240.4 | 258.5 |
| Post-test weight, g | 181.4 | 195.0 |
| Amount consumed, g | 59.0 | 63.5 |
| Test duration, sec | 5 | 5 |
| $P_C$ at start/$P_C$ at end, psi | 392/375 | 390/365 |
| Regression rate, in/sec | 0.0349 | 0.0369 |
| Consumption Rate, g/sec | 11.8 | 12.6 |

Figure 2:
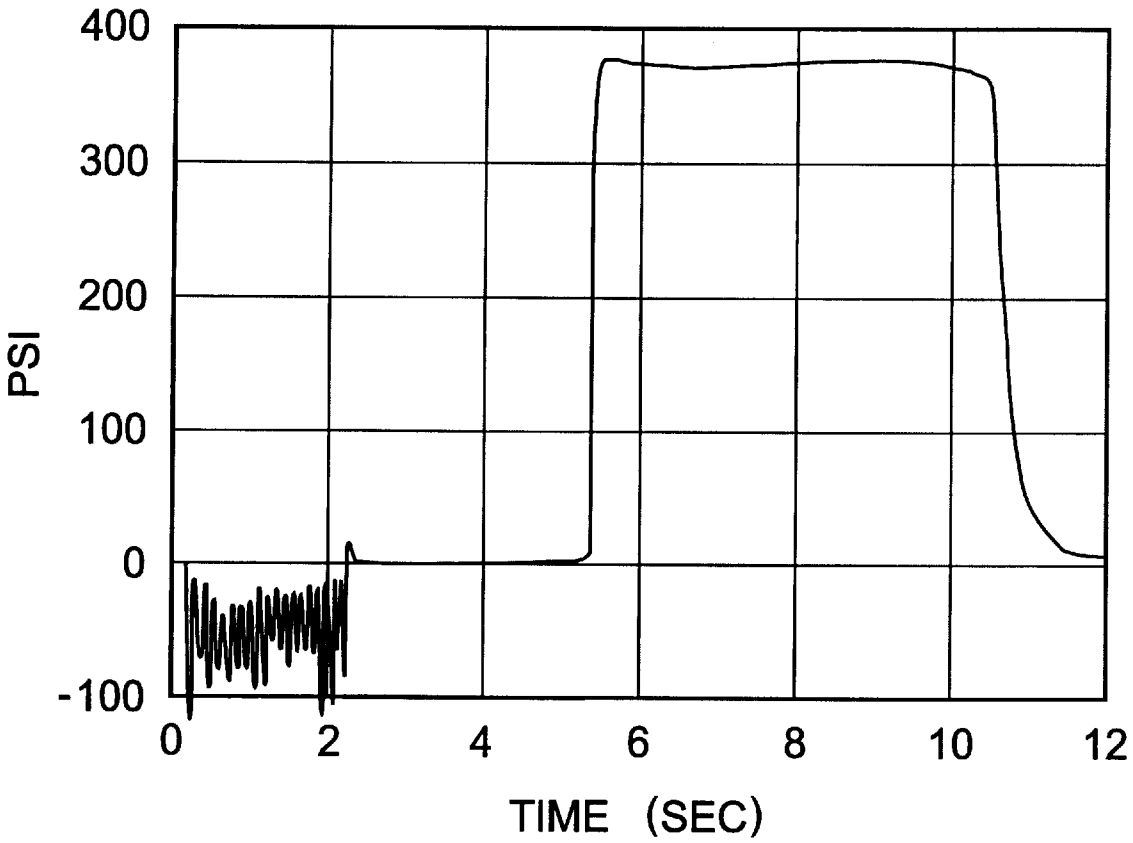
FIG. 2 is a plot of a firing run of a hybrid propellant in accordance with the present invention.

The data in Table I show a faster drop in chamber pressure, an increase in the amount of fuel consumed, an incrase in the regression rate, and an increase in the consumption rate, when the formulation of the invention is compared to that of the prior art. A comparison of FIGS. 1 and 2 shows a 5% increase in burning rate in the formulation containing the azodicarbonamide (FIG. 2) relative to the prior art formulation (FIG. 1). Since azodicarbonamide has a negative heat of formation, this increase indicates that a substantially greater increase would be obtained with an azo compound that had a positive heat of formation.

Heating tests were performed by heating one-cc samples of the two cured formulations on hot plates. Heating was continued until gas evolution ceased, and the two samples were cooled, dissected and compared. The formulation from Example 2 had increased in bulk volume and was filled with pores of approximately a millimeter or less in diameter. In contrast, the formulation from Example 1 had not increased in volume and was non-porous.

EXAMPLE 3—This Invention

A hybrid propellant incorporating an azo compound in accordance with the present invention was prepared by adding 12.5 parts by weight of Compound No. VI above to a mixer containing 71.1195 parts by weight of hydroxypolybutadiene R 45 AS, and the contents were mixed at ambient temperature without vacuum for five minutes. This was followed by the addition of another 12.5 parts of Compound No. VI, and mixing was continued for another five minutes without vacuum. After scraping down any incompletely mixed materials from the wall of the mixer, mixing was continued while vacuum was slowly applied, and mixing was continued under full vacuum for ten minutes. Hexamethylene diisocyanate (3.8805 parts by weight) was added and mixing was continued for 25 minutes. The resulting mixture had a binder-to-azo compound ratio of 75:25. The completed mixture was cast into a mold and cured at 140° F. After seven days of curing, the propellant had a Shore A hardness of 32. Other test results were as follows:

Bureau of Mines Impact Sensitivity: 36.1 cm/2 kg

Rotary Friction: greater than 4,000 g at 2,000 rpm

Electrostatic Sensitivity: greater than 1 joule

Differential Thermal Analysis: onset: 176° F.; exotherm 271° F.

The foregoing is offered for purposes of illustration. It will be readily apparent to those skilled in the art that further modifications and substitutions can be made in the formulations and their methods of preparation and use without departing from the spirit and scope of the invention.

I claim:

1. A hybrid propellant comprised of combustible solid components and a liquid oxidizer, in which said solid components include a compound containing the group R—N═N—R', where R and R' are organic radicals containing nonaromatic carbons bonded to the N═N, which upon heating to a temperature above about 110° C. decomposes to nitrogen gas and free radicals of R and R'.

2. A hybrid propellant in accordance with claim 1 in which said group R—N═N—R' has a positive heat of formation.

3. A hybrid propellant in accordance with claim 1 in which said compound is azodicarbonamide.

4. A hybrid propellant in accordance with claim 1 in which one of R and R' is a member selected from the group consisting of aliphatic, alicyclic and heterocyclic radicals, and substituted derivatives thereof substituted with a member selected from the group consisting of —CN, —OH, —OR", —COOH, —COOR", —CO—$NH_2$, and —CO—NHR", in which R" is a member selected from the group consisting of lower alkyl and hydroxy-substituted lower alkyl.

5. A hybrid propellant in accordance with claim 1 in which both R and R' are members independently selected from the group consisting of aliphatic, alicyclic and heterocyclic radicals, and substituted derivatives thereof substituted with a member selected from the group consisting of —CN, —OH, —OR", —COOH, —COOR", —CO—$NH_2$, and —CO—NHR", in which R" is a member selected from the group consisting of lower alkyl and hydroxy-substituted lower alkyl.

6. A hybrid propellant in accordance with claim 1 in which both R and R' are members independently selected from the group consisting of aliphatic and alicyclic radicals, and substituted derivatives thereof substituted with a member selected from the group consisting of —CN, —OH, —OR", —COOH, —COOR", —CO—$NH_2$, and —CO—NHR", in which R" is a member selected from the group consisting of $C_1$–$C_3$ alkyl and hydroxy-substituted $C_1$–$C_3$ alkyl.

7. A hybrid propellant in accordance with claim 1 in which said compound has the formula

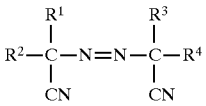

in which $R^1$, $R^2$, $R^3$, and $R^4$ are members independently selected from the group consisting of H, $C_1$–$C_8$ alkyl, $C_1$–$C_8$ alkyl substituted with a member selected from the group consisting of $C_1$–$C_3$ alkoxy and —COOH, and $C_2$–$C_8$ alkyl interrupted by a member selected from the group consisting of —O— and —COO—; or $R^1$ and $R^2$ are combined to form a $C_5$–$C_8$ nonaromatic cyclic group, and $R^3$ and $R^4$ are as defined above; or $R^1$ and $R^2$ are combined to form a first $C_5$–$C_8$ nonaromatic cyclic group, and $R^3$ and $R^4$ are combined to form a second $C_5$–$C_8$ nonaromatic cyclic group.

8. A hybrid propellant in accordance with claim 7 in which $R^1$ is methyl, $R^3$ is methyl, and $R^2$ and $R^4$ are members independently selected from the group consisting of H, $C_1$–$C_8$ alkyl, $C_1$–$C_8$ alkyl substituted with a member selected from the group consisting of $C_1$–$C_3$ alkoxy and —COOH, and $C_2$–$C_8$ alkyl interrupted by a member selected from the group consisting of —O— and —COO—.

9. A hybrid propellant in accordance with claim 7 in which $R^1$ is methyl, $R^3$ is methyl, and $R^2$ and $R^4$ are members independently selected from the group consisting of $C_1$–$C_4$ alkyl, $C_1$–$C_4$ alkyl substituted with a member selected from the group consisting of $C_1$–$C_3$ alkoxy and —COOH, and $C_2$–$C_4$ alkyl interrupted by —COO—.

10. A hybrid propellant in accordance with claim 7 in which $R^1$ and $R^2$ are combined to form a first $C_5$–$C_8$ nonaromatic cyclic group, and $R^3$ and $R^4$ are combined to form a second $C_5$–$C_8$ nonaromatic cyclic group.

11. A hybrid propellant in accordance with claim 1 in which said compound is

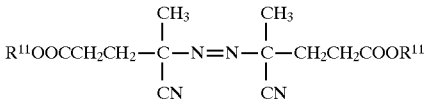

in which $R^{11}$ is $C_1$–$C_3$ alkyl.

12. A hybrid propellant in accordance with claim 1 in which said compound is

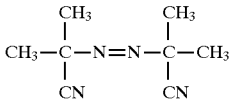

13. A hybrid propellant in accordance with claim 1 in which said compound is

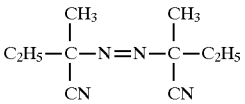

14. A hybrid propellant in accordance with claim 1 in which said compound is

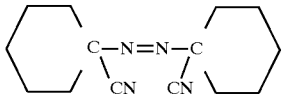

15. A hybrid propellant in accordance with claim 1 in which said compound is

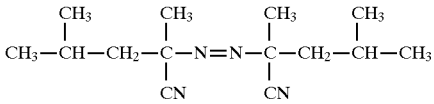

16. A hybrid propellant in accordance with claim 1 in which said compound has the formula

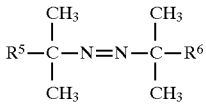

in which $R^5$ and $R^6$ are members independently selected from the group consisting of $C_1$–$C_8$ alkyl, $C_5$–$C_8$ cycloalkyl, —CO—O—$R^7$, —CO—$NH_2$, —CO—$NHR^7$,

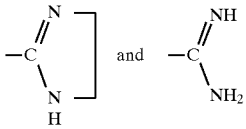

in which $R^7$ is a member selected from the group consisting of $C_1$–$C_6$ alkyl and hydroxy-substituted $C_1$–$C_6$ alkyl.

17. A hybrid propellant in accordance with claim 1 in which said compound is a plasticizer.

18. A hybrid propellant in accordance with claim 1 in which said compound is a polymeric binder.

19. A hybrid propellant in accordance with claim 18 in which said polymeric binder is a polyurethane.

20. A hybrid propellant in accordance with claim 18 in which said polymeric binder is a polyamide.

21. A hybrid propellant in accordance with claim 1 in which said solid components include a mixture of said compounds, said mixture comprising amides and esters.

22. A hybrid propellant in accordance with claim 1 in which said compound comprises from about 5% to about 70% by weight of said solid components.

23. A hybrid propellant in accordance with claim 1 in which said compound comprises from about 30% to about 60% by weight of said solid components.

24. A hybrid propellant in accordance with claim 1 in which said compound is a prepolymer having a molecular weight ranging from about 100 to about 15,000.

25. A hybrid propellant in accordance with claim 1 in which said compound is a species that is curable with an isocyanate to form a crosslinked polyurethane.

26. A hybrid propellant in accordance with claim 1 in which said compound is a species that is curable with an epoxy compound to form a crosslinked polyester.

* * * * *